United States Patent [19]

Bogen

[11] Patent Number: 4,645,434

[45] Date of Patent: Feb. 24, 1987

[54] DEVICE IN A PERISTALTIC PUMP

[75] Inventor: Jan O. Bogen, Kvicksund, Sweden

[73] Assignee: Sala International AB, Sala, Sweden

[21] Appl. No.: 801,602

[22] PCT Filed: Mar. 29, 1985

[86] PCT No.: PCT/SE85/00145

§ 371 Date: Nov. 13, 1985

§ 102(e) Date: Nov. 13, 1985

[87] PCT Pub. No.: WO85/04454

PCT Pub. Date: Oct. 10, 1985

[30] Foreign Application Priority Data

Mar. 30, 1984 [SE] Sweden ..... 8401777

[51] Int. Cl.[4] ..... F04B 43/12; F16K 15/03; F16K 15/18; F16L 55/14

[52] U.S. Cl. ..... 417/476; 251/9

[58] Field of Search ..... 417/476, 474; 418/45; 251/6, 7, 9

[56] References Cited

U.S. PATENT DOCUMENTS 2,231,579 2/1941 Huber ..... 417/476

3,726,613 4/1973 Von Casimir ..... 417/477

FOREIGN PATENT DOCUMENTS 1319159 1/1963 France .

357801 7/1973 Sweden .

*Primary Examiner*—John J. Vrablik

[57] ABSTRACT

A device in a peristaltic pump of the type including at least one pressure body (8) driven along a circular path, there being disposed concentrically around at least the major portion of this path a support structure (9, 10) accommodating an elastic hose (11) which is subjected to a local compression against the support structure by means of the pressure body as this body moves along its circular path, and an annular member (12) placed between the pressure body (8) and the hose (11), with its inner circumference abutting against the pressure body and its outer circumference abutting against the hose, towards which the annular member is locally pressed by the pressure body. The primary characteristic feature of the inventive device is a non-return valve (15) acting adjacent the end of the hose (11) connected to the pressure outlet (16) of the pump, at least part of the outer circumference of the annular member (12) together with the pressure body (8) constituting the operating means for this valve.

1 Claim, 2 Drawing Figures

DEVICE IN A PERISTALTIC PUMP

The present invention relates to a device in a peristaltic pump of the type comprising at least one pressure body driven along a circular path, a support structure concentrically disposed around at least the major part of said path and accommodating an elastic hose which is subjected to local compression towards the support structure by the action of the pressure body in response to the movement of said body along its circular path, and an annular member placed between the pressure body and the hose with its interior circumference abutting against the pressure body and its exterior circumference abutting against the hose, the annular member being locally pressed towards the hose by the pressure body.

Due to the placement of the annular member in this conventional type of pump between the pressure body or bodies and the pump hose resting on the support structure, this hose participates to a large extent in the travelling local compression along the extension of the hose as a consequence of the eccentric movement of the annular member, resulting in a very tight compression of the hose with only one stress wave per pump revolution therein because of the fact that the pressure bodies, regardless of their number, will always act on the annular member instead of each individual body acting directly on the hose.

With the annular member being dimensioned so that its outer diameter is smaller than the diameter of the inner circumference of the hose section lying in the support structure disposed concentrically around the circular path of movement of the pressure body, while its inner diameter is larger than half the diameter of the circular path of the pressure body, there is achieved an extremely high pumping effect by virtue of the pressure body or bodies being utilized for compressing the pump hose along practically its entire circular path of movement.

The object of the invention is to provide improved peristaltic pumps of the above-described type by suggesting a device appropriate for this purpose, which is simple and reliable in operation and which makes it possible for such pumps to perform considerable heights of delivery.

A device made in accordance with the present invention, which fulfills this objective and which in practical tests has proved not only reliable but also extremely gentle towards the elastic hose, is primarily distinguished by a non-return valve acting adjacent the end of the hose connected to the pressure outlet of the pump, at least part of the outer circumference of the annular member together with the pressure body constituting the operating mechanism for said valve.

The non-return valve of the inventive device is preferably designed as a movable element reciprocating in relation to the pressure outlet end of the pump hose.

In a particularly simple and uncomplicated embodiment of the invention, this movable element is formed as a flap reciprocating with its free end in relation to the pressure outlet end of the pump hose while being pivotally journalled at its opposite end, the side of said flap facing the interior of the pump housing having a cam profile for coaction with the outer circumference of the annular member. More closely defined, this coaction takes place when the pressure body by-passes the flap during which movement the pressure body, via the annular member and the cam-profiled surface on the pivotable flap, forces the free flap end towards the outlet end of the pump hose for closing it until a new amount of fluid is to be forced out through the pressure outlet under the continuous rotary movement of the pump.

It appears from the foregoing that a device performed in accordance with the invention presents a considerable advantage over the prior art technique, and this has been accomplished by means of an extremely simple and inexpensive completion of the pump construction in its entirety.

BRIEF DESCRIPTION OF THE DRAWINGS

The invention will be described in more detail below with reference to an exemplary embodiment illustrated in the drawings, of which

Figure 1:
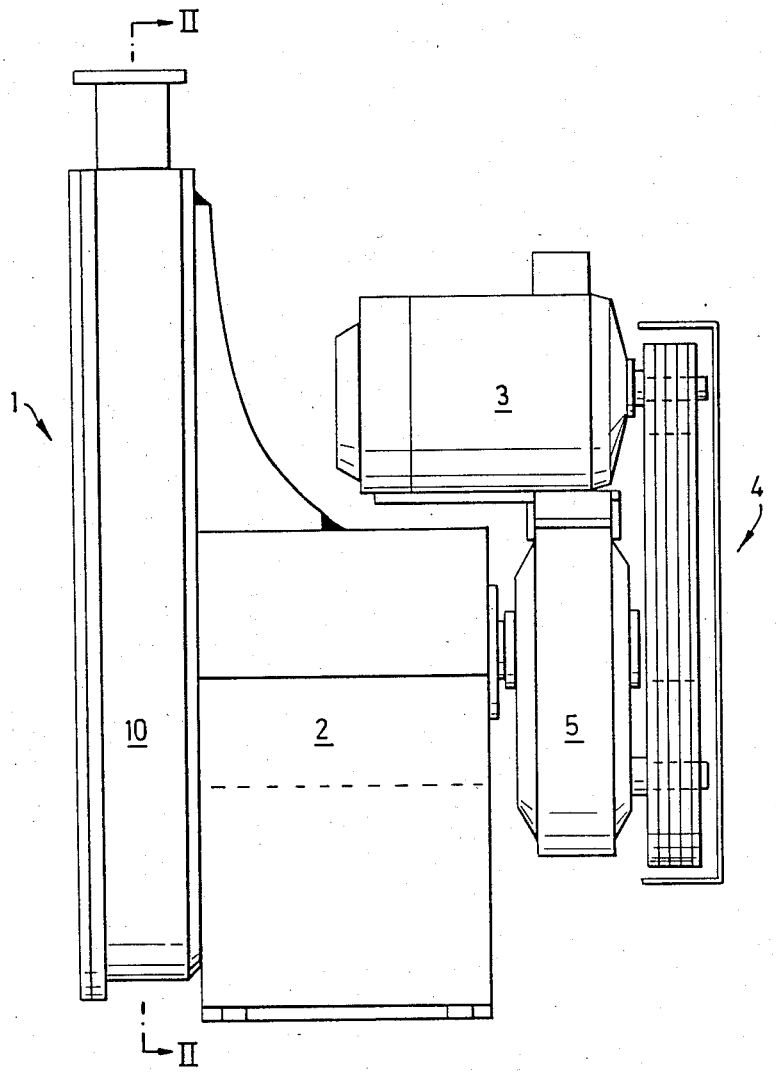
FIG. 1 is a side view of a peristaltic pump provided with the inventive device.

As can be seen from FIG. 1 of the drawings, a peristaltic pump provided with the inventive device includes a housing 1 suitably attached to a base 2, which can be anchored to a substructure. In addition to the pump housing, said base can to advantage carry the mechanism required for operating the pump, said mechanism in the embodiment shown here consisting of an electric motor 3 mounted on a gearbox 5 and having its output shaft connected to the input shaft of the gearbox via a suitable transmission means 4, said gearbox in turn being secured to the base 2 while being connected via its output shaft to the pump drive shaft which runs through the base 2 and via suitable rotary bearings further into the pump housing 1.

In the pump illustrated herein, the drive shaft 6 projecting into the pump housing 1 carries an arm 7 at the free end of which there is journalled a pressure body in the form of a roll 8. With this arrangement, the drive means of the pump will cause the pressure body or pressure roll 8 to move along a circular path inside the pump housing 1 with the drive shaft 6 constituting the center, as is particularly well disclosed in FIG. 2.

As also appears from the last-mentioned figure, the inner circumference 9 of the axial portion 10 of the pump housing 1 is shaped as a support structure concentrically surrounding at least the major portion of the circular path of movement of the driven pressure body or pressure roll 8 and accommodating the pump hose 11 required for the type of pump in question, which hose is arranged to be locally compressed against the support structure 9, 10 as the pressure body or pressure roll 8 moves around its circular path, obtaining thereby the necessary peristaltic effect and flow through the pump. In order for the hose 11 to be properly compressed, the axial portion of the pump housing having its inner circumference 9 made as a support structure for the hose is dimensioned so that its width corresponds to the width of the hose in a totally compressed state.

An annular member 12 is finally incorporated between the pressure body or pressure roll 8 and the pump hose 11 while abutting with its inner circumference against the pressure body and with its outer circumference against the hose onto which the annular member is locally pressed by the pressure body. When the pressure body or pressure roll 8 is driven along the circular path of the annular member 12 in the pump housing, the annular member will transfer the pressure from this body or roll to the pump hose 11 under local compression thereof as the annular member itself performs an eccentric movement in relation to the pump housing 1 while forcing the pump hose against its support structure 9, 10, accomplishing in this manner the peristaltic effect necessary for the pump.

The optimal peristaltic effect of the pump is obtained if the outer diameter of the annular member 12 is only slightly less than the inner diameter of the portion of the pump hose 11 lying in the support structure 9, 10 which is afforded by the pump housing 1 and is disposed concentrically around the circular path of the pressure body or pressure roll 8, the inner diameter of the annular member then being larger than half the diameter of the circular path of the pressure body or pressure roll 8 inside the pump housing.

In the pump described herein, the annular member 12 consists of a stiff steel ring 13 with an axial extension corresponding to the cross-sectional dimension of the compressed hose 11, at least the exterior of said steel ring being applied with a comparatively soft surface coating 14 of rubber or plastics, for example. The degree of softness for this coating is selected with regard to the elasticity of the pump hose and the size of the single particles in the emulsion or suspension for which the completed pump is to be employed.

Figure 2:
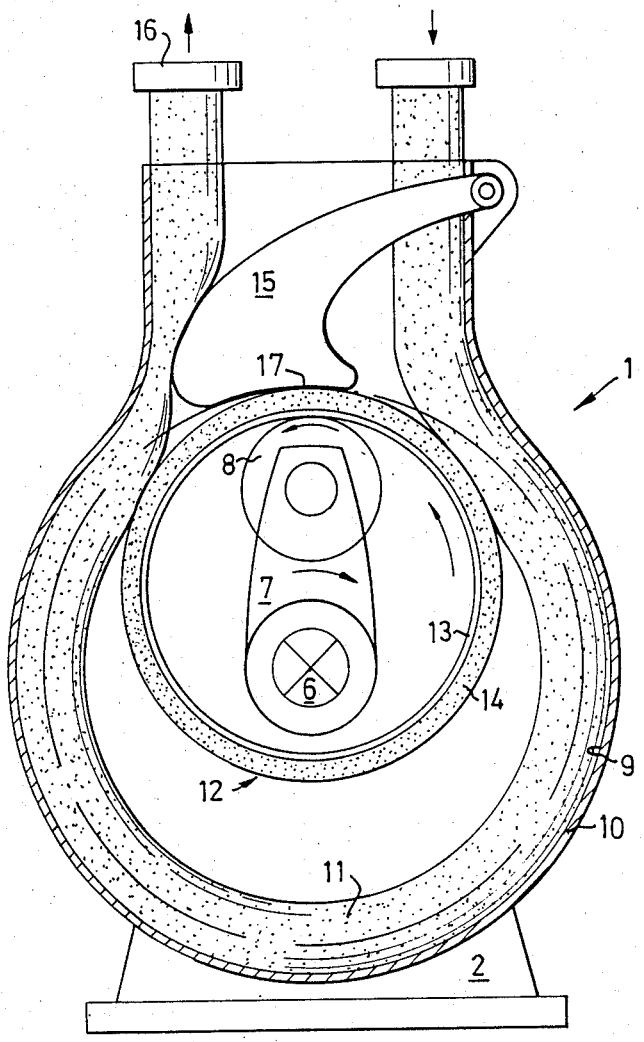
FIG. 2 is a view of a partially cut section through this pump, taken along the line II—II in FIG. 1.

As illustrated in FIG. 2, a device for peristaltic pumps made according to the invention has a non-return valve 15 at the pump hose end situated closest to the pressure outlet 16 of the pump. In the embodiment shown, this non-return valve is designed as a flap reciprocating with its free end in relation to the pressure outlet while being pivotally journalled at its opposite end, the side of said flap facing the interior of the pump housing having a cam-profiled surface 17 which, when the pressure body or pressure roll 8 by-passes the non-return valve or flap 15, is arranged to coact with the outer circumference of the annular member 12 for pushing the valve or flap against the pressure outlet end and close it until a new amount of fluid is forced out through the pressure outlet of the pump hose under continuous rotation of the pump.

The above-described exemplary embodiment of a simple and reliable device performed in accordance with the invention does not restrict the possibilities thereof. In fact, various types of non-return valves may be employed in the inventive device provided, however, that part of the outer circumference of the annular member 12 together with the pressure body or pressure roll 8 can be used as operating means for the valve.

Accordingly, the invention is not limited to the embodiment described herein and illustrated in the drawings, but can be modified in numerous ways within the scope of the following claim.

I claim:

1. Device in a peristaltic pump with at least one pressure body (8) driven along a circular path, a support structure (9, 10) concentrically disposed around at least the major portion of said path and accommodating an elastic hose (11) which is exposed to a local compression against the support stucture by the action of the pressure body in response to the displacement of said body along its circular path, and an annular member (12) incorporated between the pressure body (8) and the hose (11) while abutting with its inner circumference against the pressure body and with its outer circumference against the hose, towards which the annular member is locally pressed by the pressure body, characterized by a non-return valve (15) acting adjacent the end of the hose (11) connected to the pressure outlet (16) of the pump, at least part of the outer circumference of the annular member (12) together with the pressure body (8) constituting the operating means for said non-return valve, the non-return valve (15) being a flap with its free end reciprocating in relation to the pressure outlet end of the pump hose (11), said flap being pivotally journalled at its opposite end and presenting on its side facing the interior of the pump housing (1) a cam-profiled surface (17) for coacting with the outer circumference of the annular member (12).

* * * * *